United States Patent [19]

Serber

[11] Patent Number: 4,650,249

[45] Date of Patent: Mar. 17, 1987

[54] ERGONOMIC SEATING ASSEMBLY SYSTEM WITH FRONT CHEST SUPPORT COMPONENT, PELVIC TILT SEAT COMPONENT AND RELATED ATTACHMENTS

[76] Inventor: Hector Serber, 172 Peacock Dr., San Rafael, Calif. 94901

[21] Appl. No.: 738,274

[22] Filed: May 28, 1985

Related U.S. Application Data

[63] Continuation of Ser. No. 687,921, Dec. 31, 1984, abandoned.

[51] Int. Cl.[4] ..... A47C 1/02; A47C 7/50

[52] U.S. Cl. ..... 297/313; 248/397; 297/118; 297/195; 297/423; 297/433

[58] Field of Search ..... 248/118, 118.1, 118.3, 248/371, 398, 424; 297/195, 423, 433, 436, 313, 314, 391, 392

[56] References Cited

U.S. PATENT DOCUMENTS

| | | | |
|---|---|---|---|
| 483,266 | 9/1892 | Schindler | 248/398 X |
| 1,260,929 | 3/1918 | Maxcy | 248/118 X |
| 1,344,940 | 6/1920 | Gavin | 248/397 |
| 3,037,570 | 6/1962 | Olson | 297/423 X |
| 3,114,527 | 12/1963 | Demarest | 248/118 |
| 3,165,314 | 1/1965 | Clearman et al. | 297/423 |
| 3,759,511 | 9/1973 | Zenkin et al. | 297/423 X |
| 3,992,054 | 11/1976 | Campagnolo | 297/195 |
| 4,155,590 | 5/1979 | Cunningham | 297/195 |
| 4,156,203 | 5/1979 | Kataoka . | |
| 4,270,797 | 6/1981 | Brauning . | |
| 4,316,632 | 2/1982 | Brauning . | |
| 4,328,991 | 5/1982 | Mengshoel | 297/423 |
| 4,390,011 | 6/1983 | Evans | 248/118.3 |

*Primary Examiner*—James T. McCall

*Attorney, Agent, or Firm*—Manfred M. Warren; Robert B. Chickering; Glen R. Grunewald

[57] ABSTRACT

The invention comprises an ergonomic support system for a person in a seated position comprised of torso support platform, a seat, a shin support platform all supported by a main frame generally the size of a common chair, related attachments for facial and arm supports, further includes a pelvic tilt seat for the system to allow alignment of the body and unimpeded movement of the arms and pelvis and a healthy and comfortable position of the spine.

The support platforms are preferably padded and shaped to fit the users body telescoping legs for distance adjustment coupled to a pivotal joints for angular adjustment and sliding joints for height and lateral adjustment provide flexibility for these platforms to adjust to an individual body in various positions.

19 Claims, 6 Drawing Figures

ERGONOMIC SEATING ASSEMBLY SYSTEM WITH FRONT CHEST SUPPORT COMPONENT, PELVIC TILT SEAT COMPONENT AND RELATED ATTACHMENTS

CROSS-REFERENCE TO RELATED APPLICATION

This application is a continuation application of the patent application entitled "Support Assembly for Worker" which has the same inventor, filed Dec. 31, 1984, with Ser. No. 687,921, now abandoned.

BACKGROUND OF THE INVENTION

The field of this invention relates generally to seating apparatus for supporting a human being, and particularly chest supporting apparatus and pelvic tilt seat for holding a human being while seated. It is an integral system that supports the body in many places allowing the bone structure to remain free in it's natural curves.

Human beings, while sitting, frequently suffer from back strain resulting from their awkward position. The purpose of the invention is to have the seating structure accomodate to the body rather than have a fixed seating structure to which the body must accomodate.

The purpose also is to support the body so the muscular system can be relaxed.

Various chair devices have been developed to seat human beings but most of these devices are designed with a back rest for the back and the bottom platforms action remains related to the back rest.

Aside from the patents mentioned in the Cross Reference to Related Application, the Ergonomics Chair, U.S. Pat. Nos. 4,270,797 and 4,316,632 both by Egon Brauning, Weil Am Rhein, and two other chairs, U.S. Pat. Nos. 4,328,991 by Hans C. Mengshoel, and 4,157,203 by Emilio Ambasz offer back support in back not in the front. The pivoting seat is dependent on the back support and does not offer freedom for the pelvis to rotate.

OBJECTS OF THE INVENTION

It is a broad object of this invention to provide a seating system and method for use by a person that will support the body in an upright or bending forward position in such a way that the spinal bone structure will remain in its natural curves and the muscle tissue, tendons, and ligaments will remain relaxed even in an extreme bent forward (nearly horizontal) body posture.

Another object of this invention is to provide the seating support assembly system with an adjustable torso support structure as a method of supporting the upper body's weight directly, therefore eliminating the torque in the lower back.

Another object of this invention is a buttocks support that will allow a pelvic tilt movement around its center of rotation that is free to slide and adjusts.

It is a further object of this invention to provide an adjustable, foldout shin bone rest suppor for further support of the whole body.

It is a further object of this invention to provide chin, forehead, facial support for the weight of the head so the neck structure, bone structure, muscles, tendons and ligaments are relaxed.

Still another object of this invention is to provide adjustable, removeable tray to be used for work surface, tool, or arm rest.

Other objects and advantages of this invention will become apparent from the description to follow, particularly in read in conjunction with the accompanying drawings.

Also seating support assembly and method is possible with some or all fixed components for specific bodies and in fixed body positions.

SUMMARY OF THE INVENTION

To overcome the shortcomings of the conventional back supporting chairs and seats the invention provides a seating support assembly and method which gives support on the torso in front instead of the back, and has a pelvic tilt seat that gives free movement to the pelvis.

A first feature provides a chest support platform sized and contoured to generally fit a substantial portion of the frontal area of a typical human torso to eliminate torque in spine.

A second feature provides a buttocks support means that is generally shaped to the buttocks and is free to tilt and move forward and back and adjustable in height to allow the natural curvature of the lumbar part of the spine to remain in it's natural shape.

A third, fourth, and fifth optional feature provides means for 3, adjustable and foldable shin support for the legs, 4, facial support for eliminating strain in the neck area and 5, a shelf/tray to eliminate strain in shoulder and arms and provide a place for tools, books, or a control panel in case of a motorized wheelchair.

In a slightly different construction, seating support assembly and method is mounted on rocking rails, motorized wheels, scissors jack, or fixed frame.

DETAILED DESCRIPTION OF SPECIFIC EMBODIMENTS

Figure 1:
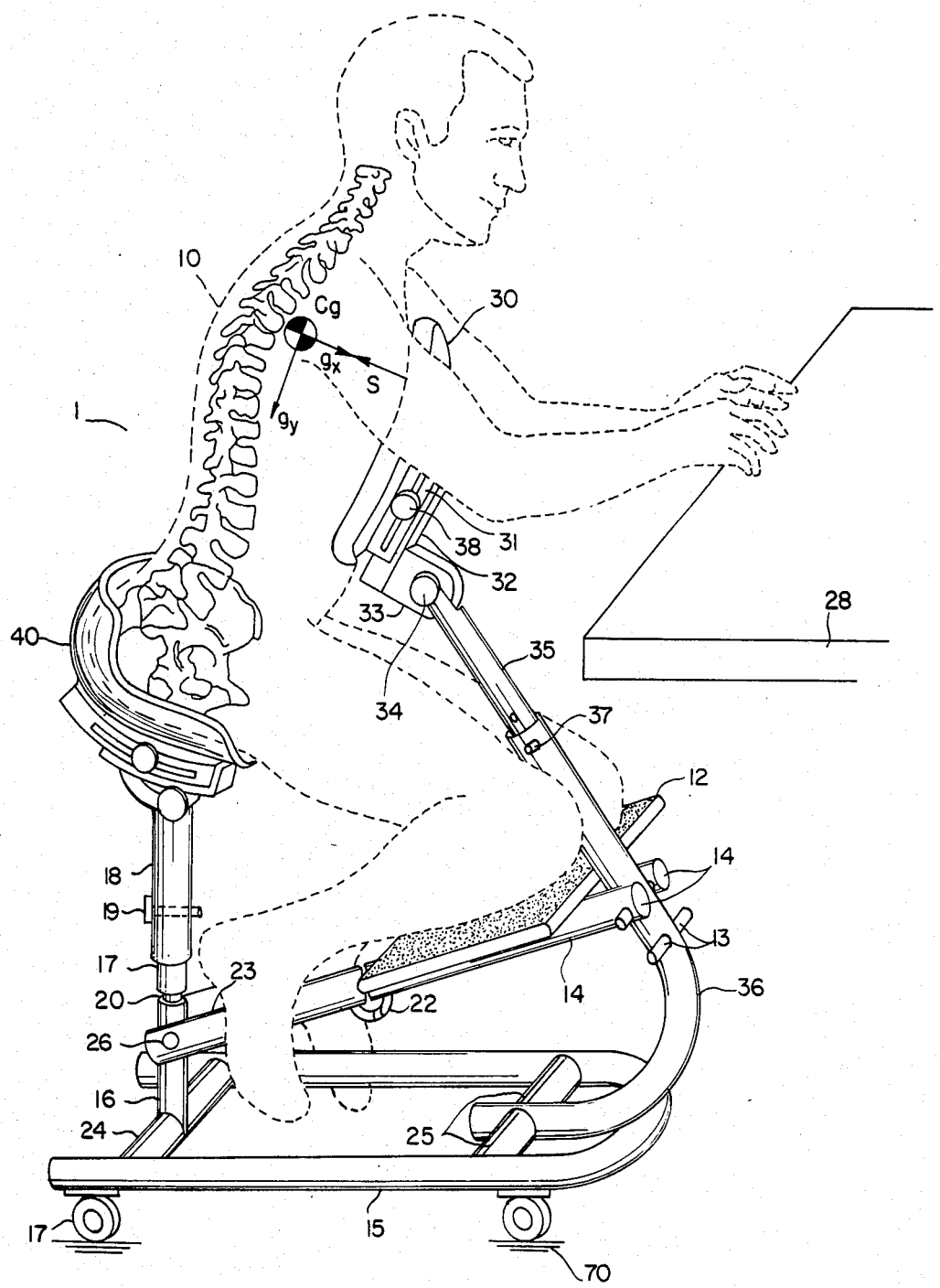
FIG. 1 is a perspective view of the ergonomic seating system assembly and method constructed with a tube frame mounted with torso, pelvic tilt and shin support platform on four wheel castors for mobility in accordance with the present invention.

Described below and shown in the drawings are specific example embodiments of that which the inventor considers at present to be the best mode of fabrication, assembly and operation for carrying out the invention. These are necessarily narrow examples, and cover only a few of the many possible ways to practice the invention. Therefore, it is to be understood that the invention itself is actually much broader in scope, as set forth in the defined by the appended claims.

OVERVIEW

Broadly stated, the invention can be quickly grasped by references to the five embodiments shown in FIGS. 1, 2, 3, 4, and 5.

The invention eliminates torque, tension, and shear of the spine of a person sitting, bending forward by distributing the weight on to a torso, buttock, facial and shin supports against which the person can lean. It also adjusts to natural lumbar curvature with a pelvic tilt seat. The invention is useful to a person sitting, relaxing, performing a task or in a therapeutic situation such as a health care worker working on the body.

The FIG. 1 first embodiment provides an Ergonomic seating system assembly and method 1 having an adjustable in angle and height front torso support 30 held up by an adjustable post 35, fixable to tube 36 which is part of the main frame 15, a pelvic tilt seat 40 fixed to an adjustable in height and rotating post 18, and a foldable shin support platform 12 securely attached to beam 14, which is connected by a hinge 22 to beam 23 pivotly attached to post 16 which is part of main frame 15 which rides on the floor on four caster wheels 17.

Figure 2:
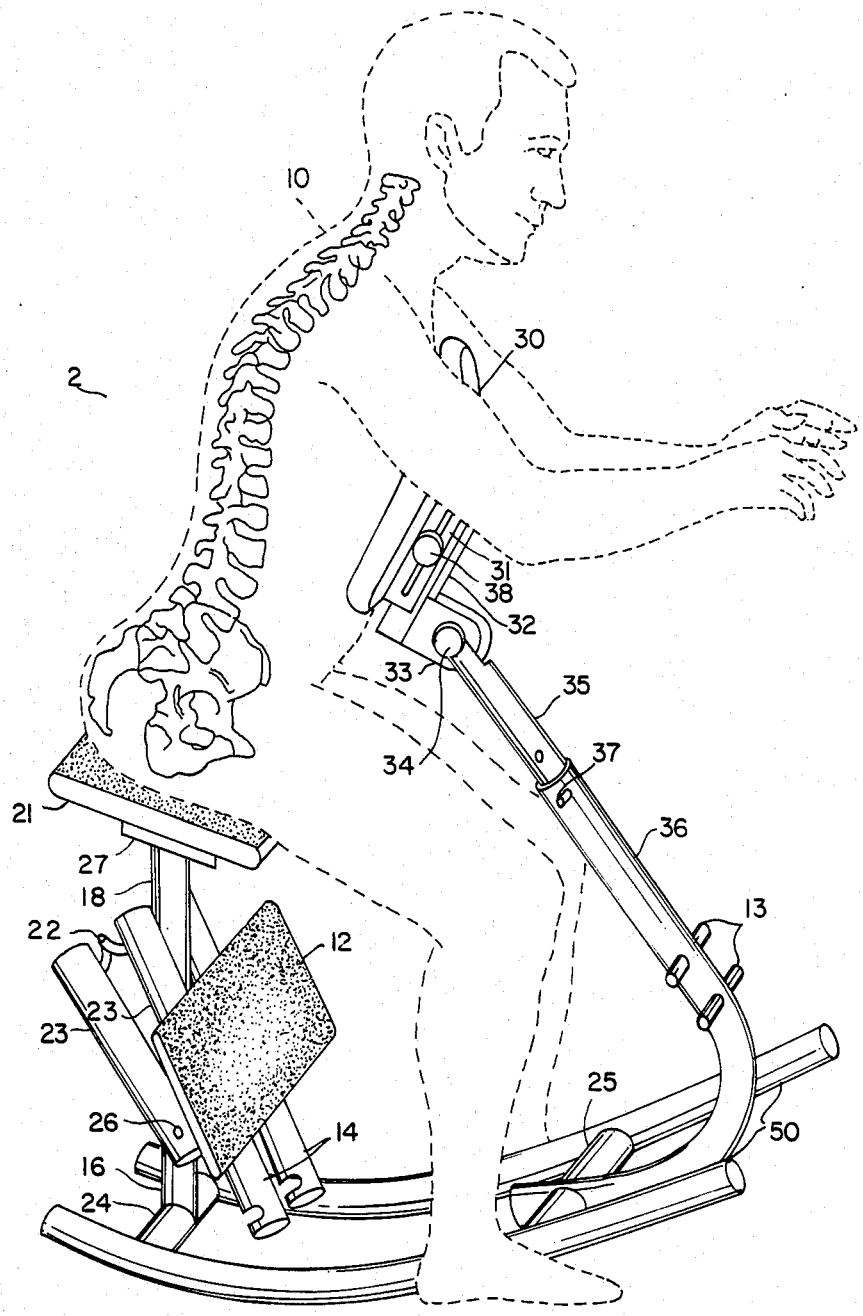
FIG. 2 is a perspective view of the Ergonomic seating system assembly and method mounted on two rocking chair rails with the shin support folded and the person's feet on the ground in accordance with the present invention.

FIG. 2 second embodiment shows an erogonomic seating system assembly and method 2 mounted on rocking chair rails 50 and shin support 12 in it's folded position with seat 21 fixed to post 18 by plate 27, a front torso support 30, adjustable and fixable to strut 35 which is adjustable and fixable to post 36.

Figure 3:
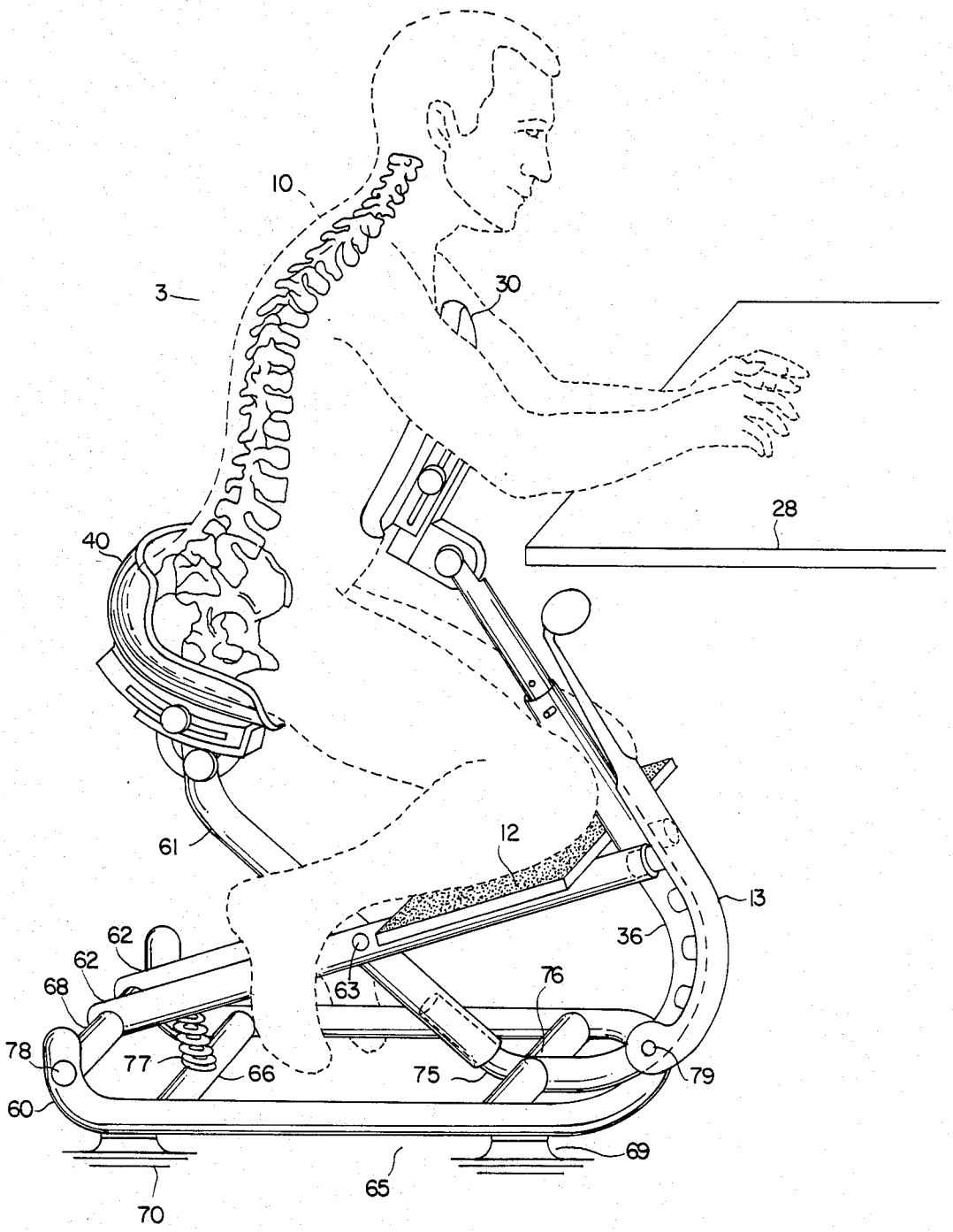
FIG. 3 is a perspective view of the Ergonomic seating system assembly and method mounted on a scissors jack type frame in accordance with the present invention.

FIG. 3 shows a third embodiment of the Ergonomic seating system assembly and method 3 provide a front torso support 30, a pelvic tilt seat 40, a shin support platform 12, on a scissor-type frame 65, composed of pivoting beam 61, attached to two pivoting beams 62 by hinging pin 63 and main frame 65 contacts floor 70, by four leg members 69.

Figure 4:
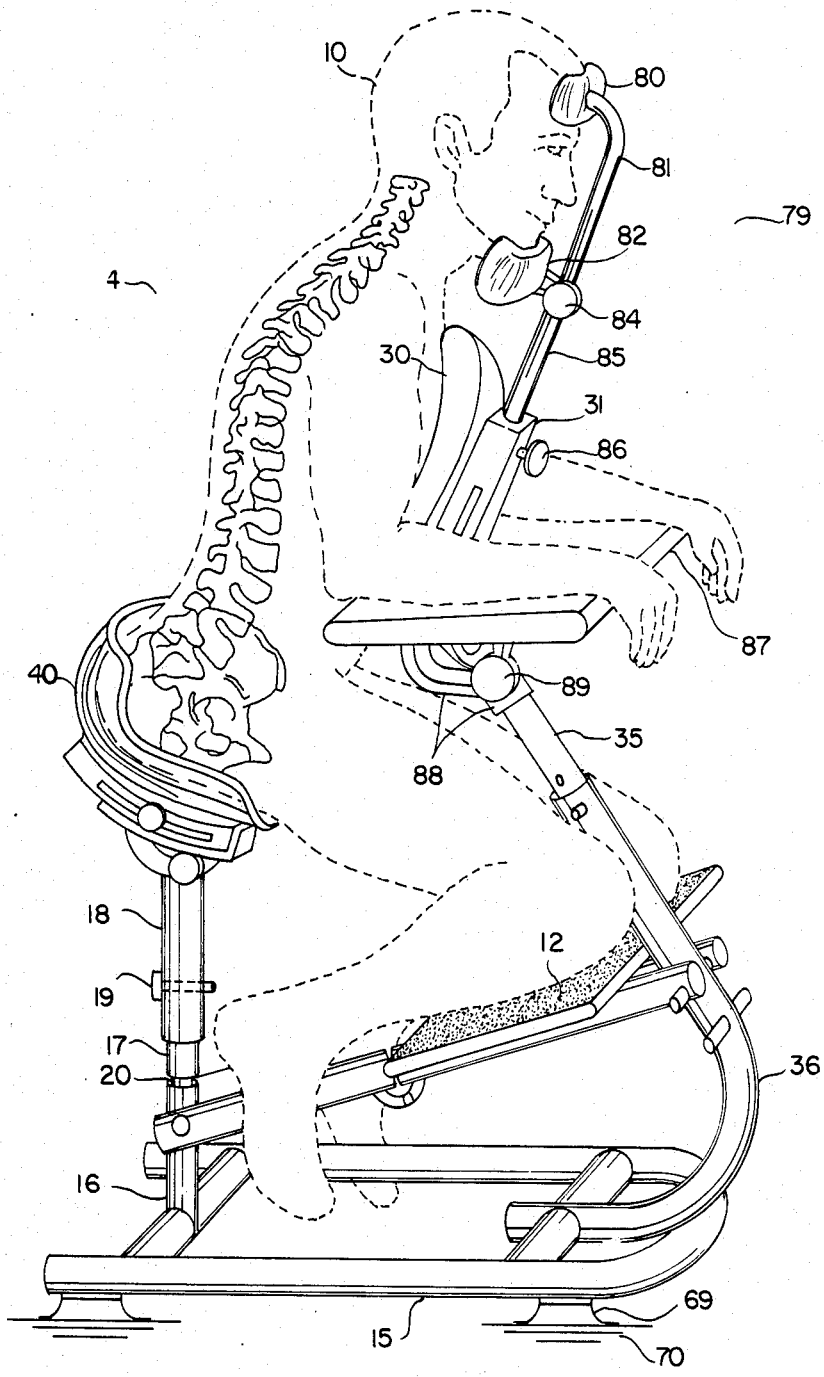
FIG. 4 is a perspective view of the Ergonomic seating system assembly and method with facial support attachment, arm rest and tray in accordance with the present invention.

FIG. 4 the fourth embodiment provides a chest support platform 30, pelvic tilt seat 40, shin support platform 12 forehead support 80, chin support 82, arm rest and tray 87, and supported person 10 in a seated position.

Common to all four embodiments is the provision of a torso support 30 dimensioned to engage and support a substantial area of the chest of a typical human torso and shaped to facilitate substantially unimpeded arm movement by the person 10 as supported on the platform and eliminates the force that acts on the body 10 that cause torque to the lumbar and pelvic areas. Additionally, embodiments 2, 3, and 4 provide a pelvic tilt seat 40 to further eliminate torque and shear forces in the spine by providing freedom of movement of the pelvic area.

Figure 5:
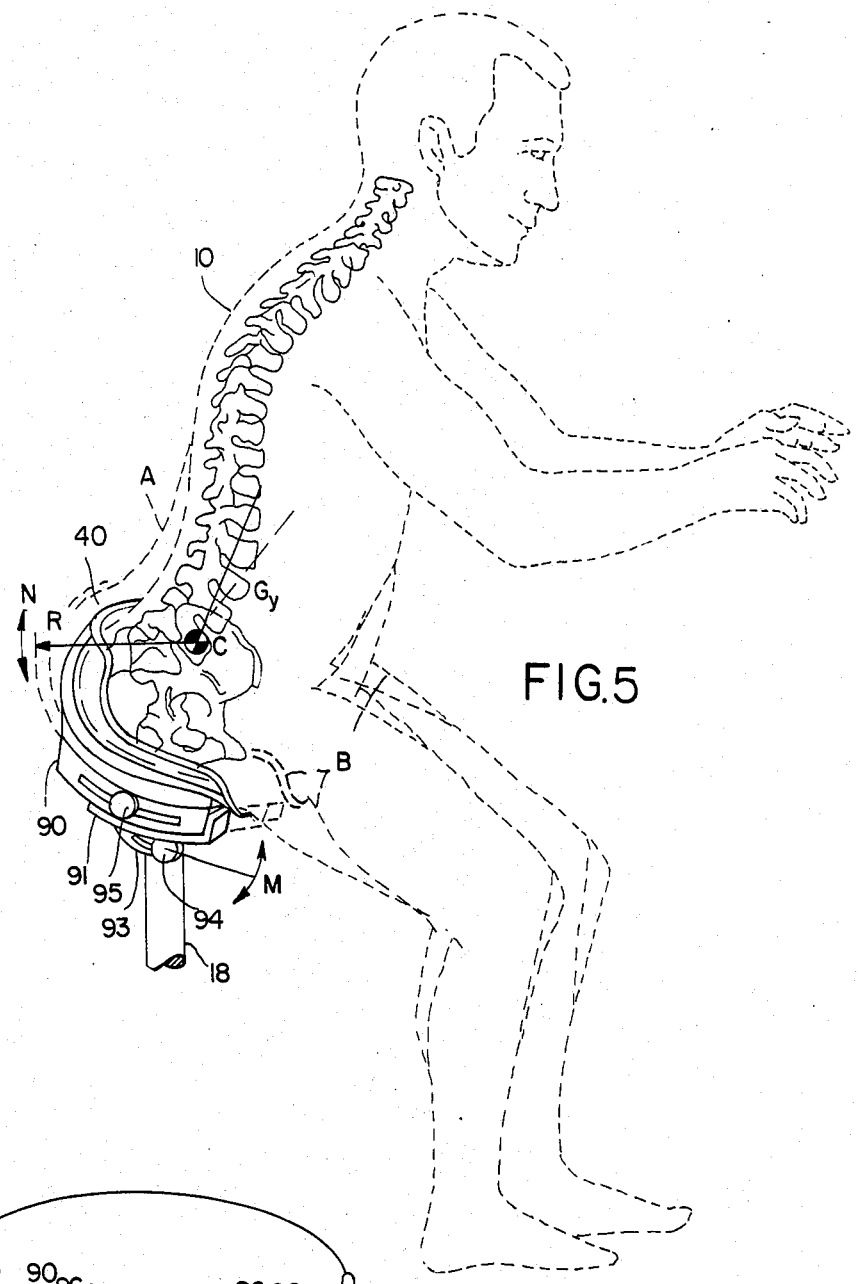
FIG. 5 shows a front and side view of the Ergonomic pelvic tilt seat in use and the person standing with feet on the ground and upright back in accordance with the present invention.

FIG. 5 shows a more detailed embodiment of the pelvic tilt seat 40.

DETAIL: APPARATUS AND USE

Referring now to FIG. 1 with greater particularity, the Ergonomic seating system assembly and method 1 of this invention may take the form of main supporting frame 15 with welded cross bars 24 and 25 mounted on wheels 17 with support post 36 and 16 being integrally part of the main frame. Post 35 is telescopically adjustable for height on support post 36 by securing pin 37, plate 33 is pivotally attached to strut 35 for angular adjustment by bolt and knob 34 and is securely attached or welded to square tube 32. Torso support platform 30 preferably cushioned and contoured to generally fit a substantial portion of the frontal area of a typical human torso is securely attached to channel 31 slidably mounted on tube 32 for height adjustment and is fixed by knob and bolt 38.

The pelvic tilt seat 40 as detailed and described by FIG. 5 beginning on page 11, line 10, pivotally attached to post 18 which is telescopically adjustable in height on tube 17 by pin 19, which permits the seat assembly to rotate on sleeve 20 onto main frame member post 16.

Shin support platform preferably cushioned 12 securely mounted on two beams 14 hooked to pins 13 on the right and securely attached to hinge 22 on the left which is securely attached to two beams 23 which are pivotally attached to main frame member 16 by pin 26.

FIG. 1 shows as an example office worker 10 supported by the ergonomic seating system assembly and methods at a table 28 with a center of gravity CG upon which the component forces of gravity Gx and Gy act, and the effects of the equal and opposit force S provided by the torso support 30 eliminates the torque created by force GX which would have acted on the pelvis and lumbar of person 10.

Referring now to FIG. 2 with greater particularity, the Ergonomic seating system assembly and method 2 of this invention may take the form of a front torso support platform 30 as described on page 8, line 9, attached to channel 31 slidingly mounted on channel 32 fixable by bolt and knob 38 securely attached to plate 33 pivotally mounted for angular adjustment to strut 35 fixable by bolt and knob 34 and telescopically adjustable and fixable to tube 36 securely attached or welded to tubes 25 which in turn are securely attached to two rocking chair rails 50 and fixed or welded to tubed 24 as part of main frame and shin support platform 12 in it's folded position by hinge 22 and pivotally attached by pin 26 to post 16.

A fixed seat 21 securely attached to plate 27 which is attached or welded to tube 18 telescopically adjustable on tube 17 by pin 19 on sleeve 20 which permits rotation onto fixed post 16 as described in FIGS. 1 and 2.

FIG. 2 depicts as an example person 10 with feet on the floor and free to rock.

Referring now to FIG. 3 with greater particularity the ergonomic seating system assembly and method 3 of this invention may take the form of main frame 65 which lies on floor 70 by four leg pads 69 and cross members 66 and 76 are securely attached or welded.

Shin support 12 is securely mounted to two beams 62 pivotally attached to 60 through sleeves 68 which contain an inner shaft 78 pivoting strut 61 which attaches to pelvic tilt seat 40 shown in FIG. 5 pivots approximately on its center by pin 63 onto beam 62 and also slides up and down on sleeve 75. Locking arrangement 13 pivots on tube 36 by pin 79 and it is used to adjust the height of beams 62 which in turn adjusts the height of pelvic tilt seat 40 and shin support 12. Spring 77 acts on cross member 66 and beams 62 to ease adjustment.

FIG. 3 shows a person 10 at a work surface 28 supported by the ergonomic seating system assembly and method.

Referring now to FIG. 4 with greater particularity the ergonomic seating system assembly and method 4 of this invention may take the form of FIG. 1 as described with the addition of facial support 79 a forehead support 80 securely attached to a post 81 which fits into tube 85 and is adjustable, securely attached by clamp tightening know 84. A chin support preferably padded and moulded which is integrally part of tube 85 which fits into sleeve 31 and is adjustable and fixable by bolt and knob 86.

A forearm rest and tray 87 slidable on strut 35 for height adjustment by sleeve and arm 88 being securely attached to 87 and fixable by bolt and knob 89. Also in place of wheel casters 17, leg pads 69 contact the ground 70. This facial attachment 79 is used to hold the head so that the neck or cervical structure is relaxed. The arm rest 87 is for the mid back or thoracic structure to be relaxed. This model would also be appropriate for therapeutic and handicapped purposes.

FIG. 5 is a perspective view of the pelvic tilt seat 40 and example person 10 showing what one of the possible radius of curvature are of pelvic tilt seat 40 centered approximately in front of the lumbar region of person 10 and two outlines A and B of the person 10 at a different position and how curved, sliding means 90 and 91 rotate allowing compression force Gy to realign along the spine without causing significant tension, torque and sheer in the lower spinal structure of person 10. Sliding motion N and rotating motion M.

Figure 6:
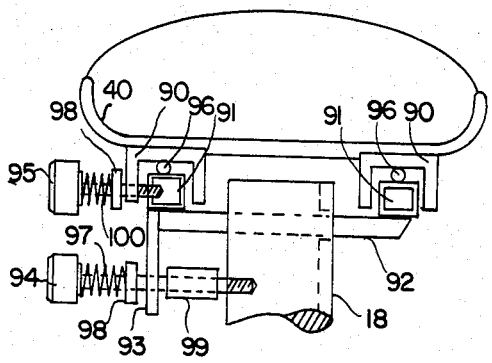
FIG. 6 is a front view of the pelvic tilt seat.

FIG. 6 is a front view of the pelvic tilt seat 40 showing how it slides forward and back by two inverted chanels 90 mounted on sliding bearing balls 96 sliding on two square tubes 91 which are securely attached or welded to shaft 92 for pivoting motion running through holes placed approximately diametric through structural member 18 and which in turn attaches to any main frame.

Semi circle slotted, flat plate 93 is securely attached to member 91. Bolt and knob 94 runs through slot of plate 93 and screws into member 18 and contains spring 97 and two friction washers 98 and 99 and opperates to regulate the degree of freedom of the pivoting motion of pelvic tilt seat 40.

Bolt and knob 95 screws into tube 91 passing by slot in inverted channel 90, contains spring 100 and friction washer 98 and is used to regulate the degree of freedom of forward and back sliding movement of pelvic tilt seat 40.

While this invention has been described above in conjunction with several example preferred embodiments thereof, it is obvious that modifications and changes may be made by those skilled in the art to which it pertains without departing from the spirit and scope of the invention.

The invention claimed is:

1. A human combined seat and torso support apparatus on which a person can support his/her body while in a sitting position and still perform tasks, comprising:

a. a main frame;

b. a seat mounted on seat support means to said main frame in a near horizontal orientation;

c. a chest support platform dimensioned to engage and support a portion of the torso of the person primarily in the area of the rib cage above the abdomen and having a peripheral edge thereof shaped to facilitate unimpeded arm movement by the person when the person's torso is supported on the platform; and d. platform support means coupled to said platform and positioning said platform above and proximate a side of said seat in a near vertical orientation, said support means supporting said platform and a portion of the weight of the person's torso in a stable position permitting relaxation of the person's back muscles and alignment of the spinal column while seated on said seat.

2. The apparatus as defined in claim 1 wherein, said seat support means is formed for mounting of said seat to said frame for sliding movement of said seat with respect to said frame along an upwardly concaved arcuate path having a radius of curvature centered at approximately the center of radiation of the pelvis of the person while the person is seated on said seat.

3. The apparatus as defined in claim 1 or 2, and a shin support platform mounted to said frame for movement between a deployed position below said seat supporting the person's shins while seated on said seat and a stored position for unimpeded manipulation of the person's legs while seated on the seat.

4. A pelvic tilt seat which allows free rotation of the pelvis of a person about a generally horizontal axis in forward and backward directions to allow adjustment of the position of the buttocks of the person in relation to the natural position of the spine for a given generally fixed position of the person's torso, comprising:

a. a main frame;

b. a seat dimensioned to engage and support a seated person thereon; and c. sliding seat support means mounting said seat to said frame for movement along an arcuate path which is upwardly concaved and has a center of curvature proximate the center of rotation of the pelvis of a person seated on the seat, said seat support means being further formed for sliding movement of said seat along said path while the person is supported on said seat.

5. A method of supporting the body of a person in a seated position with the upper body of the person oriented in a near vertical but forwardly tilted orientation, the method comprising the steps of:

a. supporting the person's buttocks for sliding movement in fore and aft directions on seat means mounted for sliding movement in a plane generally transverse to the person's upper body; and b. supporting the person's chest by a peripherally unencumbered support platform, with said platform being supported in a stable position near vertical but forwardly tilted position permitting relaxation of the person's back muscles while seated on said seat means and permitting fore and aft adjustment of said seat means while the person's upper body is supported by said platform.

6. A method of supporting a person while seated comprising the steps of:

a. positioning under the person's buttocks a supporting platform; and b. supporting said platform for movement along an upwardly curved path having a center of curvature proximate the axis of rotation of the pelvis of the person seated on said platform, said supporting step further including supporting said platform for sliding movement along said path while the person's weight is supported on said platform.

7. The apparatus as defined in claim 3 wherein, said shin support platform is mounted for adjustment of at least one of the height of said shin support platforms below said seat, the distance of said shin support platform forwardly and rearwardly with respect to said seat and the angle of said shin support platform with respect to said seat when said shin support platform is in said deployed position.

8. The pelvic tilt seat as defined in claim 4 wherein, said seat support means includes a channel defining element having an arcuate guide slot therein, and a guided member slidably mounted in said slot, said channel defining member being carried by one of said seat and said frame and said guided member being carried by a remainder of said seat and said frame.

9. The pelvic tilt seat as defined in claim 8 wherein, said slot in said channel defining member includes a support surface for sliding support of said guided element thereon which is substantially horizontally oriented over the length of said slot.

10. The pelvic tilt seat as defined in claim 4, and means for selectively applying a friction force to vary the force required to produce sliding movement of said seat along said arcuate path.

11. The pelvic tilt seat as defined in claim 4 and in combination therewith, a torso support means mounted for support of the torso of the user while seated on said seat, said torso support means being tilted in a slightly forward direction from vertical.

12. The pelvic tilt seat as defined in claim 11 wherein, said torso support means is mounted to said frame for adjustment of at least one of the height above said seat at which the user's torso is engaged, the distance in front of said seat at which the user's torso is engaged, and the angle with respect to the vertical at which the user's torso is engaged.

13. The pelvic tilt seat as defined in claim 11 wherein, said torso support means is mounted to said frame for adjustment of all of the height above, distance in front of, and angle of, said torso support means.

14. An ergonomic chair including a frame, a torso support platform mounted to the frame in a stable position and dimensioned and shaped to engage and support a portion of the user's torso primarily in the area of the rib cage and having a peripheral edge shaped to facilitate unimpeded arm movement, a seat mounted to said frame and formed and dimensioned for support of the user's buttocks thereon, wherein the improvement in said chair comprises:

said seat is mounted to said frame inclined in a direction tilting said seat toward said torso support platform, and said torso support platform is mounted to said frame to provide torso support in a plane substantially normal to the plane of said seat whereby said torso support platform can be used to support the chest of the user when the user is seated on said seat and facing said torso support platform and can be used to support the back of the user when the user is seated on said seat and facing away from said torso support platform.

15. The ergonomic chair as defined in claim 14 wherein, at least one of said seats and said torso support platform is mounted for rotation about a vertical axis to enable selective support of the user's chest and back by said torso support platform without leaving said seat.

16. The ergonomic chair as defined in claim 14 wherein, said torso support platform is mounted to said frame in spaced relation to said seat to define a clearance therebetween dimensioned for positioning of the legs and knees of the user between said platform and said seat.

17. The apparatus as defined in claim 1 wherein, said platform support means is formed for all of: pivoting of said platform about a horizontally oriented axis, adjustment of the height of said platform with respect to said seat, and varying of the distance in front of said seat, with said platform support means being formed to accomplish each of said pivoting, adjustment and varying independently of the other.

18. The apparatus as defined in claim 17 wherein, said platform support means includes means for selectively locking said platform against each of pivoting, adjustment of the height and varying of the distance.

19. The method as defined in claim 5 wherein, the step of supporting the person's buttocks is accomplished by supporting said seat means for sliding movement along a curved path while the person is seated on said seat means with the path having a center of curvature proximate the center of rotation of the person's pelvis.

* * * * *